US007904983B2

(12) United States Patent
Jun et al.

(10) Patent No.: US 7,904,983 B2
(45) Date of Patent: Mar. 15, 2011

(54) METHOD OF CONTROLLING A MULTI-TUB WASHING MACHINE

(75) Inventors: Byoung Chan Jun, Suwon-si (KR); Jung Ho Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 862 days.

(21) Appl. No.: 11/657,638

(22) Filed: Jan. 25, 2007

(65) Prior Publication Data

US 2008/0022465 A1 Jan. 31, 2008

(30) Foreign Application Priority Data

Jul. 25, 2006 (KR) ..... 10-2006-0070006

(51) Int. Cl.
*D06F 35/00* (2006.01)

(52) U.S. Cl. ..... 8/158; 68/27

(58) Field of Classification Search ..... 68/11, 27; 8/158, 159

See application file for complete search history.

(56) References Cited

U.S. PATENT DOCUMENTS

| | | | | |
|---|---|---|---|---|
| 3,231,909 | A * | 2/1966 | Candor | 8/159 |
| 3,824,813 | A * | 7/1974 | Davis | 68/12.15 |
| 5,887,456 | A * | 3/1999 | Tanigawa et al. | 68/20 |
| 6,539,753 | B1 * | 4/2003 | Ito et al. | 68/3 R |
| 6,618,887 | B2 * | 9/2003 | Kim et al. | 8/158 |

FOREIGN PATENT DOCUMENTS

| | | |
|---|---|---|
| JP | 03-021294 | 1/1991 |
| JP | 03-021295 | 1/1991 |
| JP | 10-15276 | 1/1998 |
| KR | 10-2004-0009400 | 1/2004 |
| KR | 10-2006-0004377 | 1/2006 |
| WO | WO 0212609 A1 * | 2/2002 |

OTHER PUBLICATIONS

Chinese Office Action for corresponding Chinese application 200710005793.6; issued Sep. 4, 2009.

* cited by examiner

*Primary Examiner* — Michael Barr
*Assistant Examiner* — David Cormier
(74) *Attorney, Agent, or Firm* — Staas & Halsey LLP

(57) ABSTRACT

A method of controlling a washing machine having a first washing tub and a second washing tub, the method having the operations: receiving a first operating command to be performed in the first washing tub; determining whether the operating command can be performed; and when the operating command can be performed, performing the operating command in the first washing tub.

10 Claims, 14 Drawing Sheets

METHOD OF CONTROLLING A MULTI-TUB WASHING MACHINE

CROSS-REFERENCE TO RELATED APPLICATIONS

This application claims the benefit of Korean Patent Application No. 10-2006-0070006, filed on Jul. 25, 2006 in the Korean Intellectual Property Office, the disclosure of which is incorporated herein by reference.

BACKGROUND OF THE INVENTION

1. Field of the Invention

The present invention relates to a washing machine, and more particularly to a method of controlling a multi-tub washing machine, which controls washing procedures of one washing tub in consideration of washing procedures of the other washing tub while driving at least two washing tubs simultaneously.

2. Description of the Related Art

In general, a drum type washing machine washes laundry in a washing tub by performing an operating command, which may call for one or more processes, e.g., washing, rinsing and dehydrating processes. A recently developed washing machine is equipped with a drying device for drying dehydrated laundry. But since a conventional washing machine includes one washing tub, a user should sort the laundry according to a kind or dyeing of cloth, and put a first sorted group of laundry, which can be washed together, into the washing tub. After the washing of the group of laundry is completed, the user has to put another sorted group of laundry that can be washed together into the washing tub. Since, in this case, the washing machine will be operated twice or more, it is highly time and energy consumptive. Further, if a relatively small volume of laundry is washed by a large capacity washing machine, power consumption is increased unnecessarily.

To solve the above problems, a twin-tub washing machine for performing an independent washing operation in each tub has been developed, and is disclosed in Korean Patent Laid-open Publication No. 10-2004-0009400. Such a washing machine has a large capacity washing tub and a small capacity washing tub, which are driven individually or simultaneously.

But when the large capacity and small capacity washing tubs are driven simultaneously, the washing operations (i.e., water supplying, washing, rinsing, dehydrating and drying processes) of one washing tub affects the washing operations of the other washing tub. In more detail, when the water supplying process or the draining process is performed in two washing tubs simultaneously, the water may be supplied insufficiently in the washing tubs or discharged incompletely from the washing tubs. When the dehydrating process is performed in two washing tubs simultaneously, noise may be generated due to resonance and the washing machine may even break. When the water heating process or the drying process is performed in two washing tubs simultaneously, or when the water heating process and the drying process are performed together, a current overload may happen because of the simultaneous operations of heaters for heating the water and/or heaters for drying the washed laundry.

A twin-tub washing machine for solving one of the above problems (simultaneous water supplying or draining) is disclosed in Japanese Patent Laid-open Publication No. H10-15276. Such a washing machine is constructed such that a single water supply pipe and a single drain pipe is connected to two washing tubs. While the water supplying process or draining process is performed in one washing tub, the water supplying or draining in the other washing tub is prohibited and delayed.

But just to delay the water supplying or draining cannot ensure that the water is supplied sufficiently into both the washing tubs or discharged completely from both the washing tubs. Further, such a washing machine cannot solve the above-noted problems that arise during simultaneous dehydrating or drying.

BRIEF SUMMARY

The present invention has been made to solve the above problems. It is an aspect of the invention to provide a method of controlling a twin-tub washing machine capable of achieving complete water supplying or draining in the respective washing tubs upon receiving a water supplying command or a draining command to be performed in both the washing tubs simultaneously.

It is another aspect of the invention to provide a method of controlling a twin-tub washing machine capable of preventing noise or breakage of the washing machine due to resonance upon receiving a dehydrating command to be performed in both the washing tubs simultaneously.

It is yet another aspect of the invention to provide a method of controlling a multi-tub washing machine capable of preventing damage of electrical components due to an overload upon receiving a water heating command or a drying command to be performed in both the washing tubs simultaneously or upon receiving the water heating command to be performed in one washing tub and the drying command to be performed in the other washing tub.

The foregoing and/or other aspects of the present invention are achieved by providing a method of controlling a washing machine including a first washing tub and a second washing tub, the method including: receiving a first operating command to be performed in the first washing tub; determining whether the first operating command can be performed; and when the first operating command can be performed, performing the first operating command in the first washing tub.

According to one aspect, the determining includes: when a second operating command is being performed in the second washing tub and the first and second commands require a same process, determining that the first operating command is incapable of being performed.

According to one aspect, the method further includes: when the operating command is incapable of being performed in the first washing tub, delaying performing the first operating command in the first washing tub until the second operating command is completed in the second washing tub.

According to one aspect, the method further includes: upon receiving a second operating command to be performed in the first and second washing tubs simultaneously, determining which of the first washing tub and the second washing tub has a priority; and performing the second operating command preferentially in the washing tub having the priority.

According to one aspect, the method further includes: upon receiving a second operating command to be performed in the first and second washing tubs simultaneously, determining which of the first washing tub and the second washing tub has a shorter remaining washing time; and performing the second operating command preferentially in the washing tub having the shorter remaining washing time.

According to one aspect, the operating command may call for any of a water supplying process, a water heating process, a draining process, a dehydrating process, and a drying process.

The foregoing and/or other aspects of the present invention are achieved by providing a method of controlling a washing machine including a first washing tub and a second washing tub, the method including: receiving a water supplying command calling for a first water supplying process to be performed in the first washing tub; determining whether the water supplying process can be performed; and when the water supplying process can be performed, performing the first water supplying process in the first washing tub.

According to one aspect, the determining includes: when a second water supplying process is being performed in the second washing tub, determining that the first water supplying process is incapable of being performed.

According to one aspect, the determining includes: determining whether a drying process is being performed in the second washing tub; and when the drying process is being performed in the second washing tub, determining that the first water supplying process is incapable of being performed.

According to one aspect, method further includes: upon receiving a drying command calling for the drying process to be performed in the second washing tub simultaneously with the first water supplying process in the first washing tub, performing the drying process preferentially in the second washing tub.

The foregoing and/or other aspects of the present invention are achieved by providing a method of controlling a washing machine including a first washing tub and a second washing tub, the method including: receiving a water heating command calling for a first water heating process to be performed in the first washing tub; determining whether the first water heating process can be performed; and when the first water heating process can be performed, performing the first water heating process in the first washing tub.

According to one aspect, the determining includes: when a second water heating process is being performed in the second washing tub, determining that the first water heating process is incapable of being performed.

According to one aspect, the determining includes: determining whether a drying process is being performed in the second washing tub; and when the drying process is being performed in the second washing tub, determining that the first water heating process is incapable of being performed.

According to one aspect, the method further includes: upon receiving a drying command calling for the drying process to be performed in the second washing tub simultaneously with the first water heating process in the first washing tub, performing the drying process preferentially in the second washing tub.

The foregoing and/or other aspects of the present invention are achieved by providing a method of controlling a washing machine including a first washing tub and a second washing tub, the method including: receiving a draining command calling for a first draining process to be performed in the first washing tub; determining whether the first draining process can be performed; and when the first draining process can be performed, performing the first draining process in the first washing tub.

According to one aspect, the determining includes: when a second draining process is being performed in the second washing tub, determining that the first draining command is incapable of being performed.

The foregoing and/or other aspects of the present invention are achieved by providing a method of controlling a washing machine including a first washing tub and a second washing tub, the method including: receiving a dehydrating command calling for a first dehydrating process to be performed in the first washing tub; determining whether the first dehydrating process can be performed; and when the first dehydrating process can be performed, performing the first dehydrating process in the first washing tub.

According to one aspect, the determining includes: when a second dehydrating process is being performed in the second washing tub, determining that the first dehydrating process is incapable of being performed.

The foregoing and/or other aspects of the present invention are achieved by providing a method of controlling a washing machine including a first washing tub and a second washing tub, the method including: receiving a drying command calling for a first drying process to be performed in the first washing tub; determining whether the first drying process can be performed; and when the first drying process can be performed, performing the first drying process in the first washing tub.

According to one aspect, the determining includes, when a second drying process is being performed in the second washing tub, determining that the first drying process is incapable of being performed.

According to one aspect, the determining includes: determining whether a water heating process is being performed in the second washing tub; and if the water heating process is being performed in the second washing tub, determining that the first drying process is incapable of being performed.

According to one aspect, the method further includes: upon receiving a water heating command calling for the water heating process to be performed in the second washing tub simultaneously with the first drying process in the first washing tub, performing the first drying command preferentially in the first washing tub.

The foregoing and/or other aspects of the present invention are achieved by providing a method of controlling a washing machine including a first washing tub and a second washing tub, each of which has a water heater and a drying heater, the method including: receiving a first operating command calling for operation of the water heater in the first washing tub; determining whether the first operating command can be performed; and when the first operating command can be performed, operating the water heater in the first washing tub.

According to one aspect, the determining includes, when the water heater in the second washing tub is operating, determining that the first operating command is incapable of being performed.

According to one aspect, the determining includes, when the drying heater in the second washing tub is operating, determining that the first operating command is incapable of being performed.

According to one aspect, the method further includes: upon receiving a second operating command calling for operation of the drying heater in the second washing tub simultaneously with operation of the water heater in the first washing tub, operating the drying heater in the second washing tub preferentially.

The foregoing and/or other aspects of the present invention are achieved by providing a method of controlling a washing machine including a first washing tub and a second washing tub, each of which has a water heater and a drying heater, the method including: receiving a first operating command calling for operation of the drying heater in the first washing tub; determining whether the first operating command can be performed; and when the first operating command can be performed, operating the drying heater in the first washing tub.

According to one aspect, the determining includes, when the drying heater in the second washing tub is operating, determining that the first operating command is incapable of being performed.

According to one aspect, the determining includes, when the water heater in the second washing tub is operating, determining that the first operating command is incapable of being performed.

According to one aspect, the method further includes: upon receiving a second operating command calling for operation of the water heater in the second washing tub simultaneously with operation of the drying heater in the first washing tub, operating the drying heater in the first washing tub preferentially.

Additional and/or other aspects and advantages of the present invention will be set forth in part in the description that follows and, in part, will be apparent from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings, of which.

DETAILED DESCRIPTION

Figure 1:
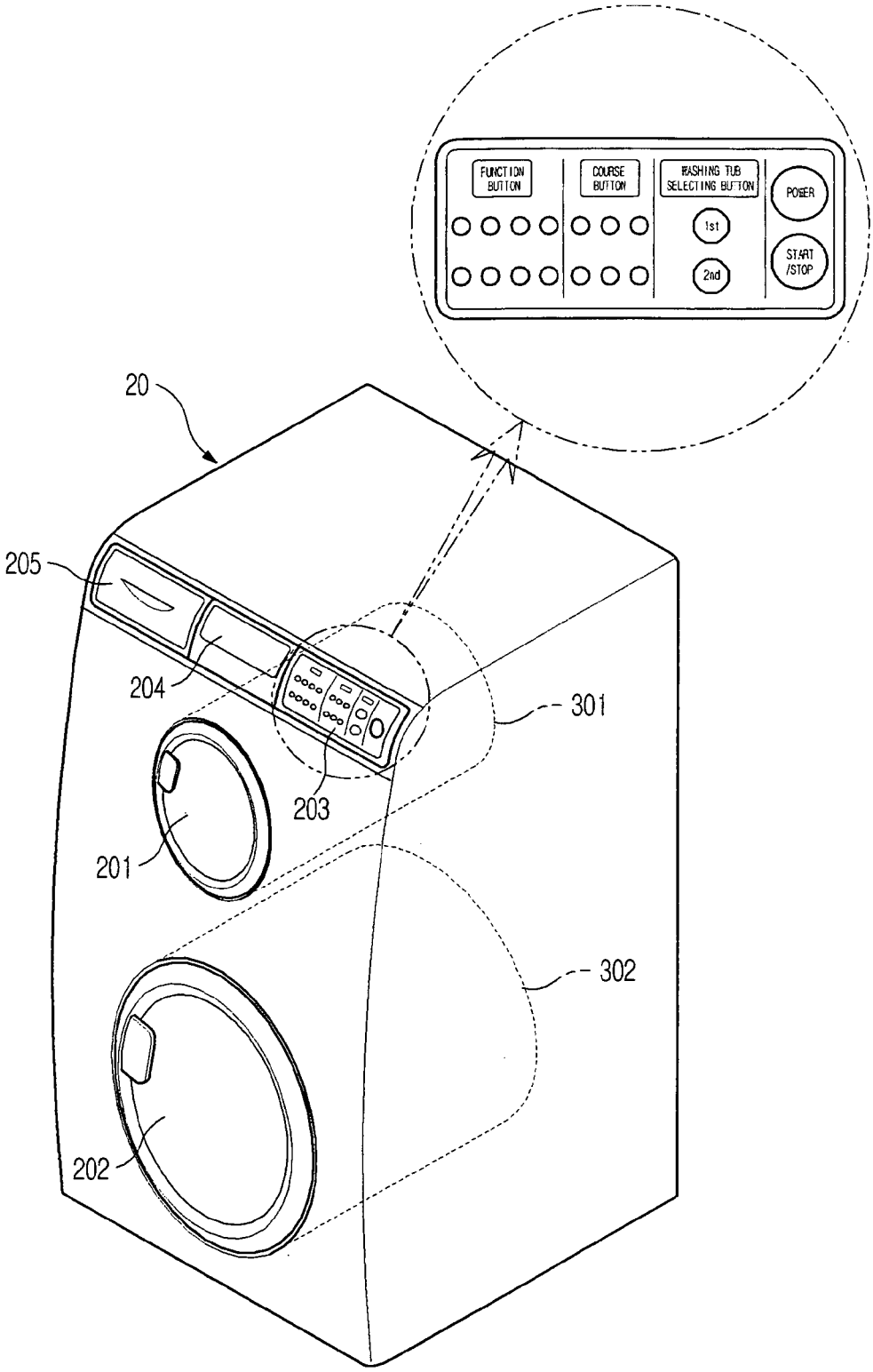
FIG. 1 is a perspective view showing a twin-tub washing machine in accordance with an embodiment of the present invention.

Reference will now be made in detail to embodiments of the present invention, examples of which are illustrated in the accompanying drawings, wherein like reference numerals refer to like elements throughout. The embodiments are described to explain the present invention by referring to the figures.

FIG. 1 is a perspective view showing a twin-tub washing machine according an embodiment of the present invention. As shown in the drawing, a twin-tub washing machine 20 is provided with an input part 203 at a top-right portion of a main body, by which a user inputs an operating command, and a display panel 204 at a top-middle portion of the main body, through which an inputted command and a washing procedure are displayed. A detergent supply part 205 is provided at a top-left portion of the main body.

A first washing tub 301 is provided below the above-described components, and a second washing tub 302 is provided below the first washing tub 301. The first washing tub 301 may have the same capacity as the second washing tub 302, or may have a capacity different from the second washing tub 302 (e.g., as depicted in FIG. 1, the first washing tub 301 has a relatively small capacity and the second washing tub 302 has a relatively large capacity). In such a case, when washing a relatively small volume of laundry, only the small capacity washing tub (first washing tub 301) is driven, to thereby save water and power. Reference numeral 201 indicates a door of the first washing tub 301, and reference numeral 202 indicates a door of the second washing tub 302.

According to one embodiment, the input part 203 is provided with a power button; an operating button to start or stop a washing operation; and selecting buttons to select the first washing tub 301 and/or the second washing tub 302, to drive the first and second washing tubs 301 and 302 individually or simultaneously. The input part 203 is further provided with course buttons to select a washing course, and function adding/deleting buttons. The construction of the input part 203 is not limited to such an embodiment, but may be changed variously.

The display panel 204 is provided to display the inputted command and the washing procedure in the respective first and second washing tubs 301 and 302. According to one embodiment, the detergent supply part 205 is partitioned into two spaces to respectively supply the detergent into the first washing tub 301 and the second washing tub 302. According to another embodiment, two detergent supply parts may be provided: one for each washing tub.

Figure 2:
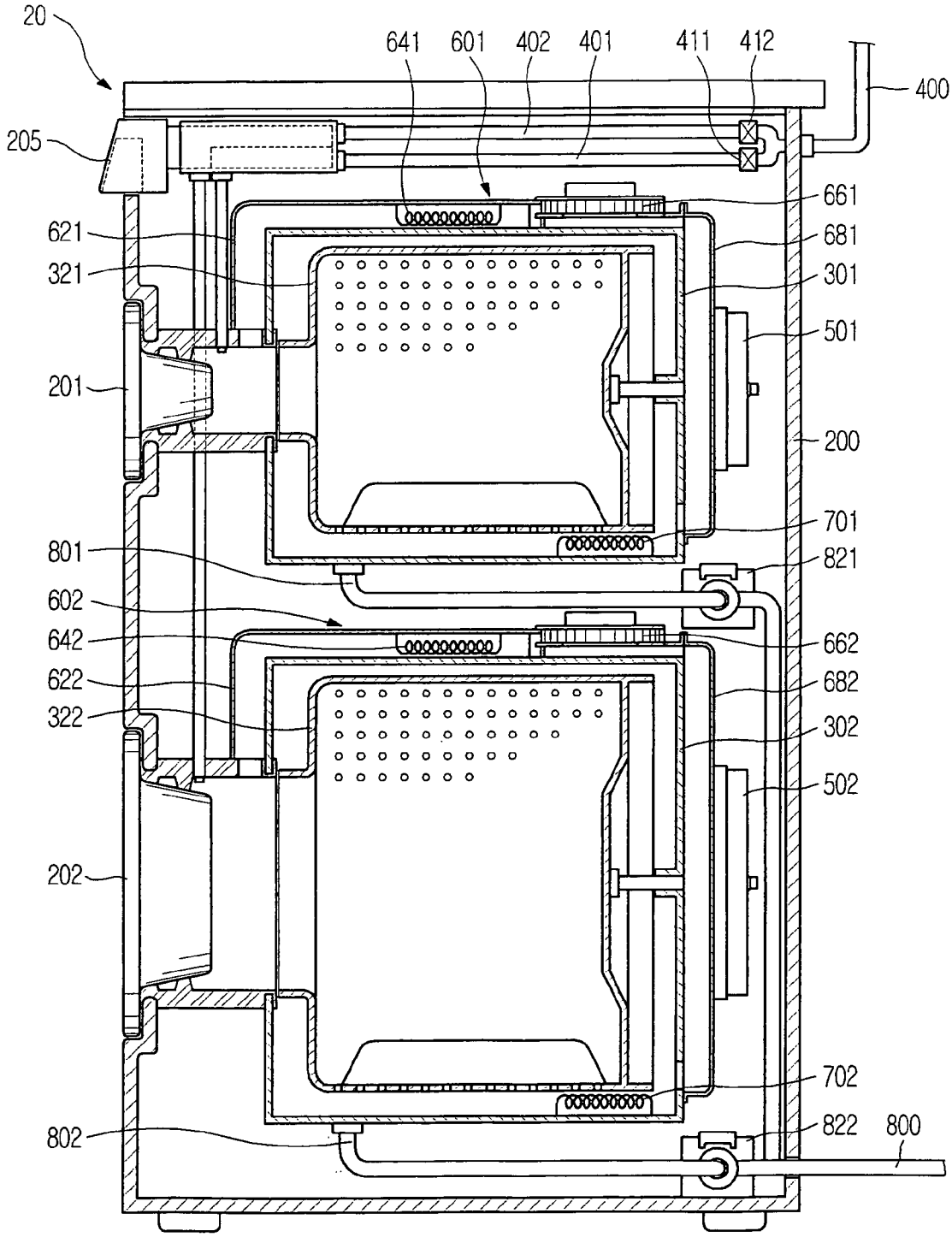
FIG. 2 is a cross-sectional view showing a structure of a twin-tub washing machine of FIG. 1.

FIG. 2 is a cross-sectional view showing the washing machine depicted in FIG. 1. As shown in the drawing, an outer case 200 forms an outer appearance of the washing machine 20. A first rotary drum 321 is mounted inside the first washing tub 301, and a second rotary drum 322 is mounted inside the second washing tub 302. The basic constitution of the first washing tub 301 is equal to that of the second washing tub 302.

An external water supply pipe 400 is connected to the outer case 301. Internal water supply pipes 401 and 402 are bifurcated from the external water supply pipe 400, and water supply valves 411 and 412 are mounted respectively at the internal water supply pipes 401 and 402. The internal water supply pipes 401 and 402 are disposed inside the outer case 301, and extend to the first and second washing tubs 301 and 302, respectively. When the valves 411 and 412 are opened, water is supplied into the first and second washing tubs 301 and 302 through the internal water supply pipes 401 and 402 via the detergent supply part 205.

According to one embodiment, driving motors 501 and 502 are mounted respectively to the first and second washing tubs 301 and 302 for rotating the same. According to another embodiment, first and second washing tubs 301 and 302 may be rotated individually or simultaneously by various driving mechanisms using, for example, a single driving motor, belts, clutches, and the like.

Drying devices 601 and 602 are mounted respectively to the first and second washing tubs 301 and 302 to dry the laundry in the washing tubs 301 and 302. The respective drying devices 601 and 602 include drying ducts 621 and 622, drying heaters 641 and 642, drying fans 661 and 662, and condensation ducts 681 and 682. Heaters 701 and 702 to heat the water (hereinafter, which is called "water heater") are mounted respectively to the first and second washing tubs 301 and 302. Internal drain pipes 801 and 802 are mounted respectively under the first and second washing tubs 301 and 302 to discharge the water, and connectingly extend to an external drain pipe 800. Drain pumps 821 and 822 are mounted to the internal drain pipes 801 and 802, respectively.

Figure 3:
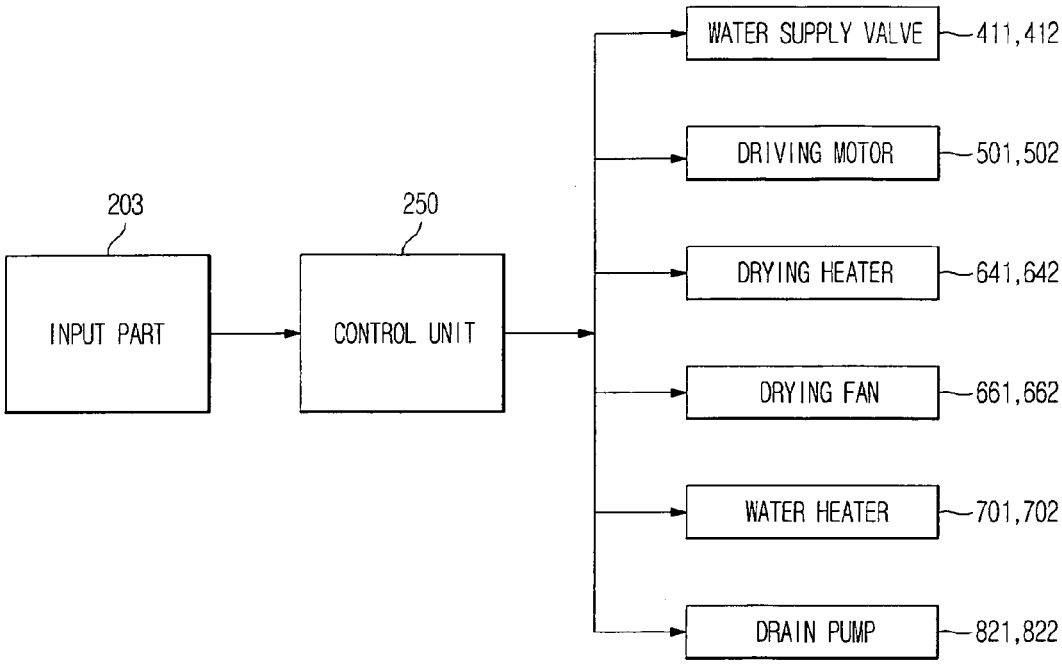
FIG. 3 is a block diagram showing an operation of a twin-tub washing machine in accordance with an embodiment of the present invention.

FIG. 3 is a block diagram showing the operation of the washing machine according to an embodiment of the present invention. When a user inputs an operating command through the input part 203, a control unit 250 controls the water supply valves 411 and 412, the driving motors 501 and 502, the drying heaters 641 and 642, the drying fans 661 and 662, the water heaters 701 and 702, and the drain pumps 821 and 822 to perform the overall washing procedures. Also, the control unit 250 discriminates conditions capable of performing each washing procedure in the first and second washing tubs 301 and 302.

A method of controlling the operation of the twin-tub washing machine will now be described with reference to FIG. 4.

When the user intends to drive only one of the washing tubs, the washing procedures can be achieved by a conventional control method. But, when the user intends to put the laundry into one washing tub and initiate the washing procedures while the washing procedures are already being performed in the other washing tub, or when the user intends to put the laundry into both the washing tubs and initiate the washing procedures simultaneously, the washing machine is controlled by the control method as shown in FIG. 4.

For convenience, the control method shown in FIG. 4 will be described using the first washing tub 301 as an example. The control method shown in FIG. 4 may also be applied to the second washing tub 302 similarly to the way that it is applied to the first washing tub 301.

Figure 4:
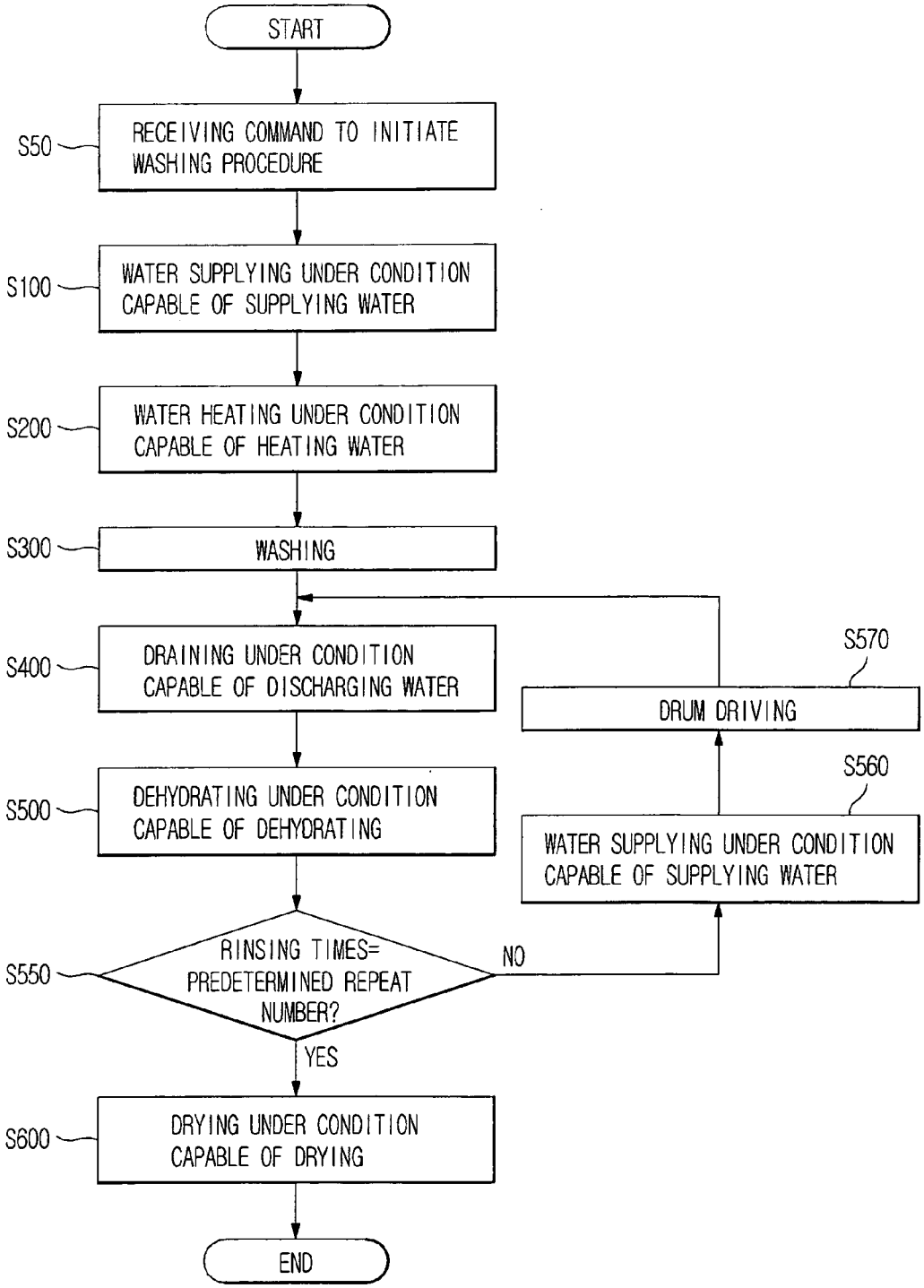
FIG. 4 is a flow chart showing a method of controlling an operation of a twin-tub washing machine in accordance with an embodiment of the present invention.

As shown in FIG. 4, initially, a command for initiating the washing procedures in the first washing tub 301 is inputted by a user via input part 203 and then received by the control unit 250 (operation S50). Next, a water supplying procedure is performed at operation S100. At this time, the water is not always supplied immediately. The control unit 250 determines whether the washing machine is in a condition capable of supplying the water into the first washing tub 301. If the washing machine is in a condition capable of supplying the water into the first washing tub 301, the water is supplied into the first washing tub 301 during a predetermined time. When it is necessary to heat the water supplied into the first washing tub 301, the control unit 250 determines whether the washing machine is in a condition capable of heating the water. At operation S200, during a water heating procedure, if the washing machine is in a condition capable of heating the water, a water heating process is performed. The water in the first washing tub 301 is heated to a predetermined temperature. According to one embodiment, after the water is heated to the predetermined temperature, a washing procedure, which includes a drum driving procedure, during which the first rotary drum 321 is driven, is performed at operation S300. According to one embodiment, the washing procedure may be performed during the water heating process. The water heating process may be omitted if the user desires the washing procedure to be performed with cold water.

When the washing procedure is completed, the control unit 250 determines whether the washing machine is in a condition capable of discharging the water from the first washing tub 301. At operation S400, during a draining procedure, if the washing machine is in a condition capable of discharging the water, a draining process is performed. When the draining process is completed, at operation S500, during a dehydrating procedure, the control unit 250 determines whether the washing machine is in a condition capable of dehydrating. If the washing machine is in a condition capable of dehydrating, a dehydrating process is performed. When the dehydrating process is completed, a rinsing procedure (operation S550) is performed. During the rinsing procedure, a water supplying procedure (operation S560, similar to operation S100), a drum driving procedure (operation S570), the draining procedure (operation S400), and the dehydrating procedure (operation S500) are repeatedly performed. The repeat number of the rinsing procedures is preset by the user. When the rinsing procedure is set to be partially different from the washing procedures, the rinsing procedure is performed according to the preset procedures. When the final dehydrating process is completed, at operation S600, during a drying procedure, the control unit 250 determines whether the washing machine is in a condition capable of drying the laundry. If the washing machine is in a condition capable of drying the laundry, a drying process is performed. When the drying process is completed, the overall washing procedures are finished.

Figure 5A:
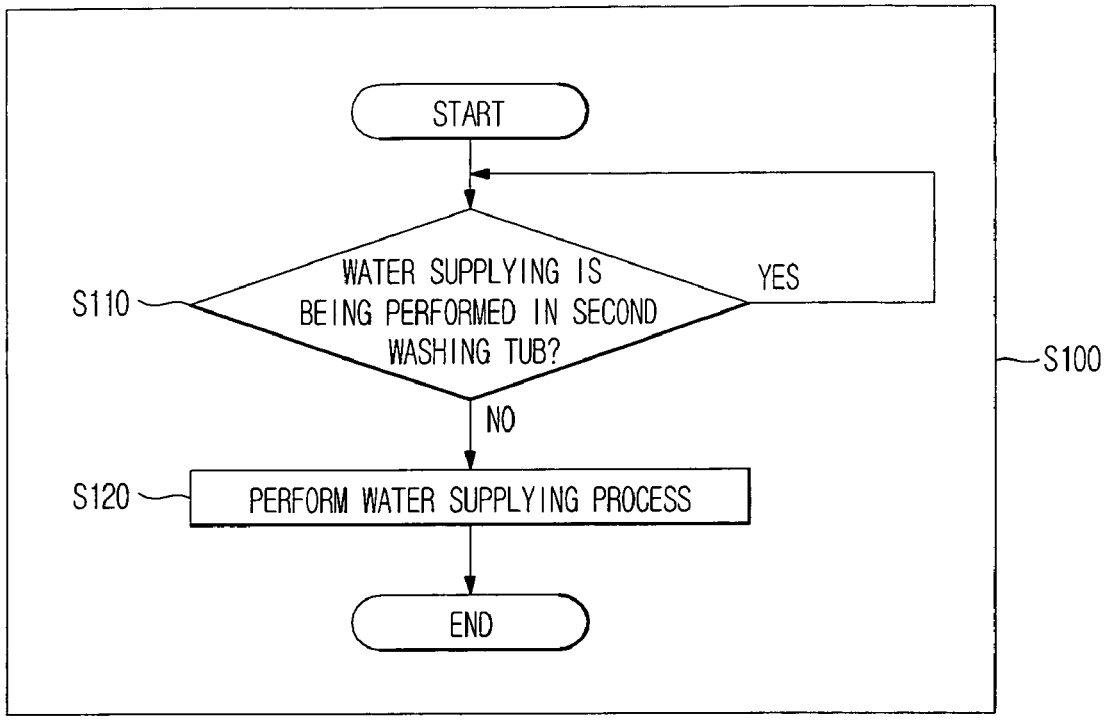
FIG. 5A is a flow chart showing a method of discriminating a condition capable of performing a water supplying process and performing the water supplying process.

The conditions capable of performing the above-described processes will now be described in detail with reference to FIG. 5A to FIG. 9. FIG. 5A is a flow chart showing a method of discriminating a condition capable of performing the water supplying process and performing the water supplying process. As shown in the drawing, to determine if the washing machine is capable of supplying the water into the first washing tub 301, the control unit 250 determines whether the water is being supplied into the second washing tub 302 (operation S110). If the water is being supplied into the second washing tub 302, the control unit 250 delays the process of supplying the water into the first washing tub 301. When water is being supplied into the second washing tub 302, if the water is supplied into the first washing tub 301 as well, then the water would be insufficiently supplied into the washing tubs 301 and 302. This is because the amount of the water flowing into each washing tub through the single external water supply pipe 400 is reduced by half. Accordingly, when the water-supply into the second washing tub 302 is completed, the control unit 250 initiates the process of supplying the water into the first washing tub 301 (operation S120), to thereby supply the water sufficiently into both the first and second washing tubs 301 and 302 during the predetermined time.

Figure 5B:
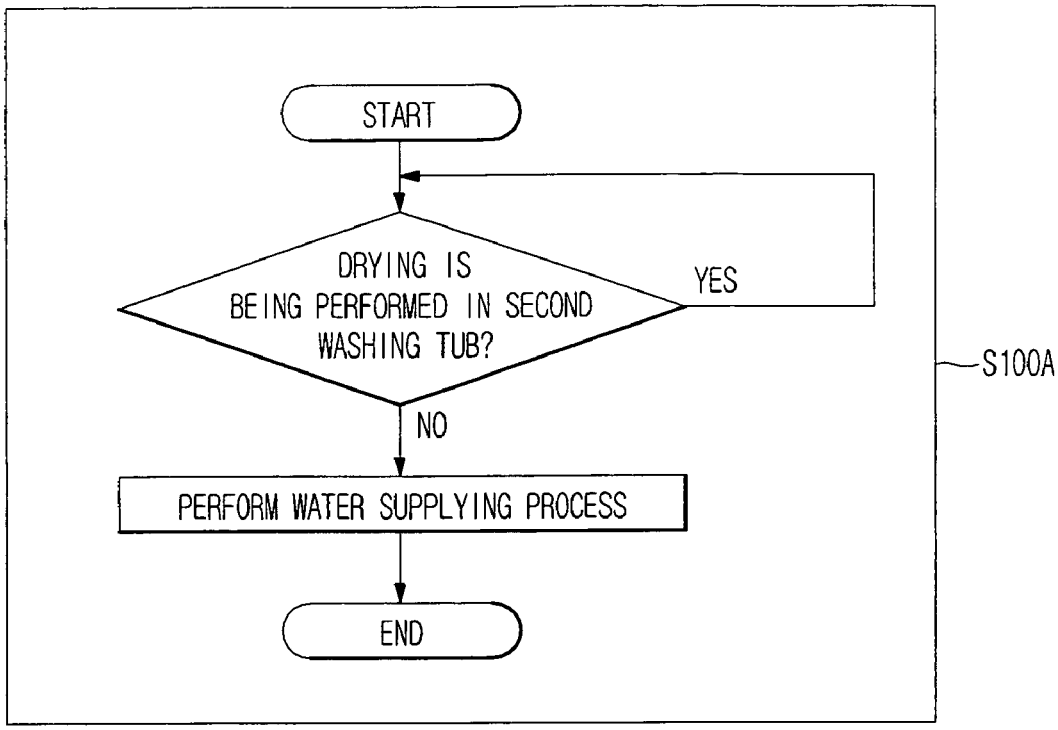
FIG. 5B is a flow chart showing another method of discriminating a condition capable of performing a water supplying process and performing the water supplying process.

As shown in FIG. 5B, according to one embodiment, when discriminating the condition capable of supplying the water into the first washing tub 301, it may be considered whether the drying process is being performed in the second washing tub 302. In case of a drying system configured such that the water is condensed in the condensation duct, the water to be condensed is injected into the condensation duct from the external water supply pipe 400, which may affect the amount of the water supplied into the first washing tub 301. Thus, when the drying process is being performed in the second washing tub 302, the process of supplying the water into the first washing tub 301 may be delayed. According to one embodiment, if the amount of the water injected into the condensation duct is slight, the above control process may be skipped.

On the other hand, it may happen to input the command of supplying the water into both the first and second washing tubs 301 and 302 at the same time. In this case, it may be controlled that the water is first supplied unconditionally into one of the first and second washing tubs 301 and 302, which has priority over the other. In other words, if the first washing tub 301 is set to have priority over the second washing tub 302, the water is not supplied into the second washing tub 302 until the water-supply into the first washing tub 301 is completed. On the other hand, if the second washing tub 302 is set to have priority over the first washing tub 301, the water is not supplied into the first washing tub 301 until the water-supply into the second washing tub 302 is completed.

Further, it may be controlled that the water is first supplied into one of the washing tubs, which satisfies a prescribed condition. For example, comparing the washing times set in the respective washing tubs, it may be controlled that the washing procedures in the washing tub having the shorter washing time are carried out first. According to one embodiment, the priority of one washing tub over the other washing tub may be decided according to the commands inputted to the respective washing tubs. For example, when the water supplying command is inputted to the first washing tub 301 and the drying command is inputted to the second washing tub 302, the remaining washing time of the second washing tub 302 is certainly shorter than that of the first washing tub 301. In this case, the drying process in the second washing tub 302 may be performed preferentially without comparing the remaining washing times in the first and second washing tubs 301 and 302.

In a similar manner, the above-described method of deciding the priority order between the first and second washing tubs 301 and 302 may be also applied to the water heating procedure (S200), the draining procedure (S400), the dehydrating procedure (S500), and the drying procedure (S600).

Figure 6A:
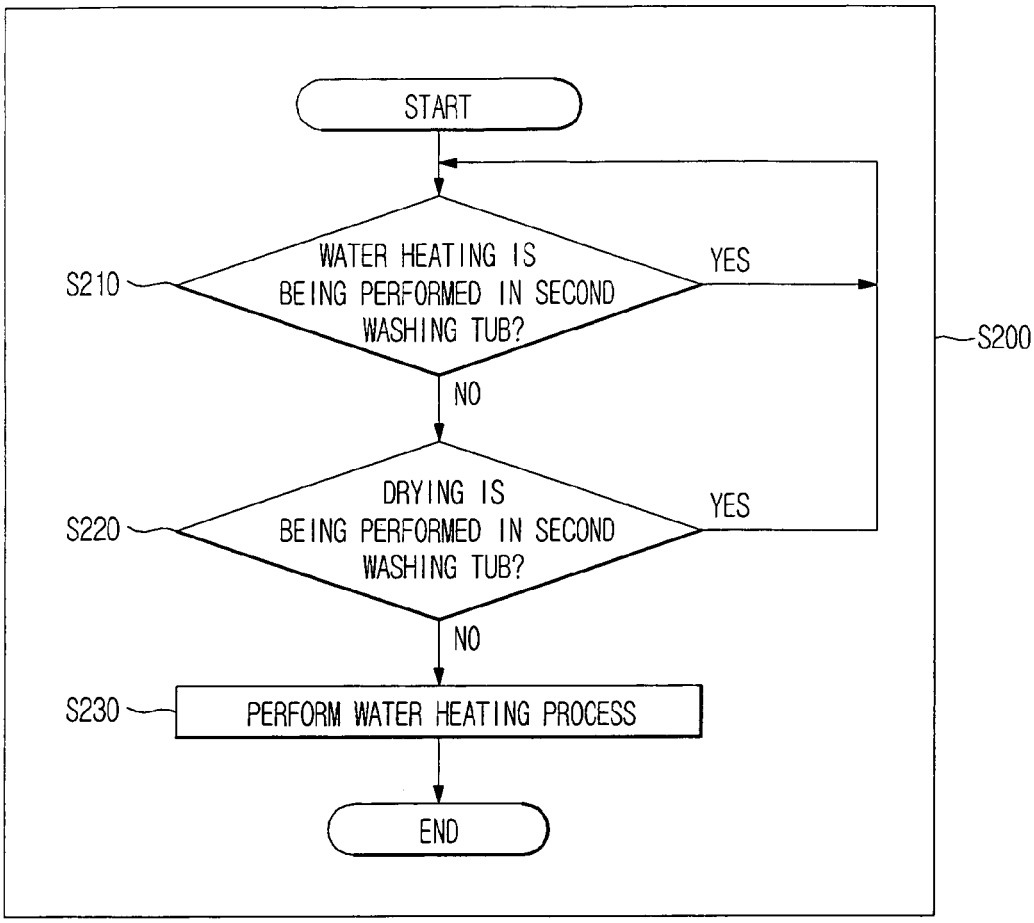
FIG. 6A is a flow chart showing an embodiment of a method of discriminating a condition capable of performing a water heating process and performing the water heating process.

FIG. 6A is a flow chart showing an embodiment of a method of discriminating a condition capable of performing the water heating process and performing the water heating process. As shown in the drawing, if the process of heating the water in the first washing tub 301 is ready to be initiated, the control unit 250 determines whether the water heating process is being performed in the second washing tub 302 (operation S210). If the water heating process is being performed in the second washing tub 302, the control unit 250 delays the water heating process in the first washing tub 301. If the water heating process is not being performed in the second washing tub 302, the control unit 250 determines whether the drying process is being performed in the second washing tub 302 (operation S220). If the drying process is being performed in the second washing tub 302, the control unit 250 delays the water heating process in the first washing tub 301. If the drying process is not being performed in the second washing tub 302, the control unit 250 initiates the water heating process in the first washing tub 301 (operation S230).

Figure 6B:
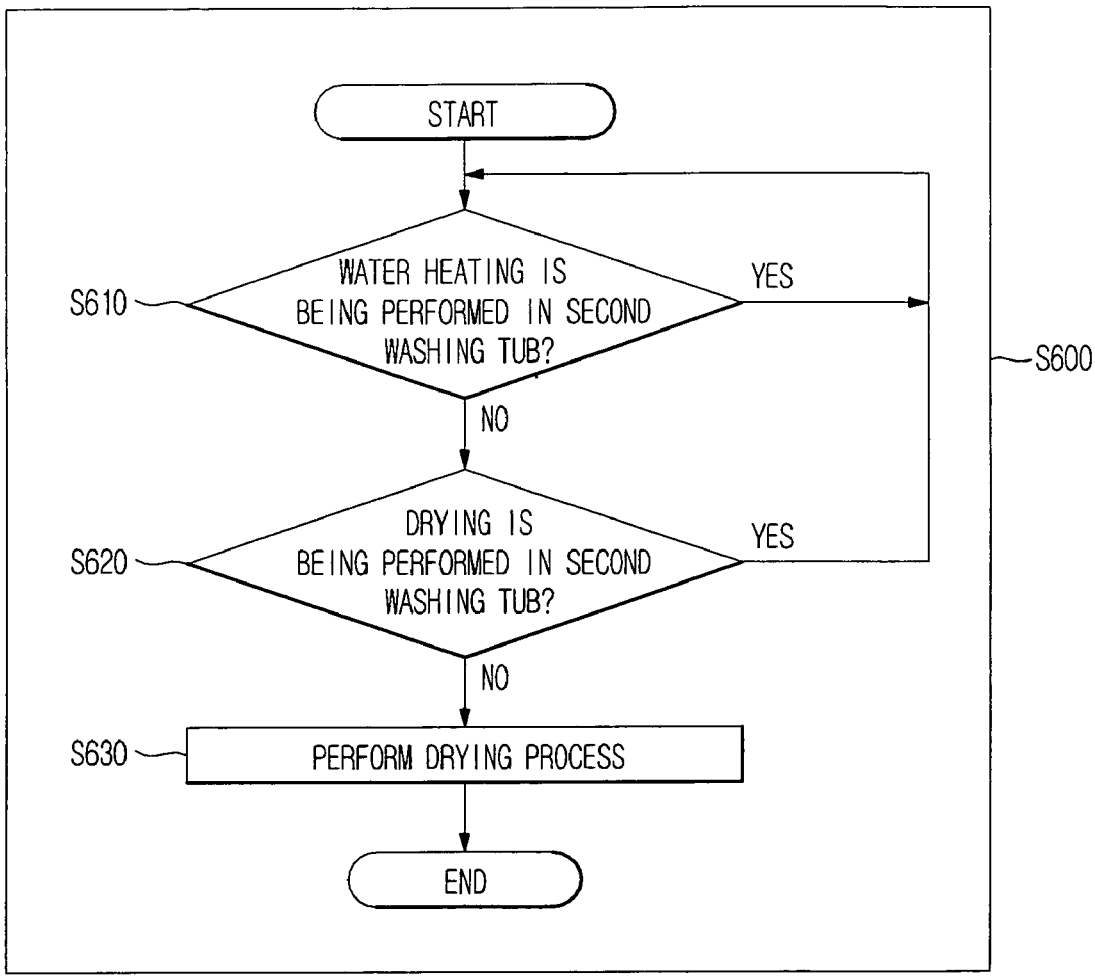
FIG. 6B is a flow chart showing an embodiment of a method of discriminating a condition capable of performing a drying process and performing the drying process.

FIG. 6B is a flow chart showing an embodiment of a method of discriminating a condition capable of performing the drying process performing the drying process. As shown in the drawing, if the drying process in the first washing tub 301 is ready to be initiated, the control unit 250 determines whether the water heating process is being performed in the second washing tub 302 (operation S610). If the water heating process is being performed in the second washing tub 302, the control unit 250 delays the drying process in the first washing tub 301. If the water heating process is not being performed in the second washing tub 302, the control unit 250 determines whether the drying process is being performed in the second washing tub 302 (operation S620). If the drying process is being performed in the second washing tub 302, the control unit 250 delays the drying process in the first washing tub 301. If the drying process is not being performed in the second washing tub 302, the control unit 250 initiates the drying process in the first washing tub 301 (operation S630).

According to one embodiment, if condensed water is used for the drying process, as described above, besides determining whether the water heating process or the drying process is being performed in the second washing tub 302, the control unit 250 may further determine whether the water supplying process is being performed in the second washing tub 302. In such a case, if the water supply process is being performed in the second washing tub 302, the control unit 250 delays the drying process in the first washing tub 301.

In general, the water heaters 701 and 702 or the drying heaters 641 and 642 consume much power. So, when operating several heaters at the same time, electrical components may be damaged or break due to an overload. To prevent this problem, while the water heating process or the drying process is being performed in the second washing tub 302, the water heating process in the first washing tub 301 is controlled not to be performed and controlled to be delayed. When the water heating process or the drying process in the second washing tub 302 is completed, the water heating process in the first washing tub 301 is initiated, to thereby avoid the simultaneous operation of the water heaters 701 and 702 and the drying heaters 641 and 642.

Figure 7A:
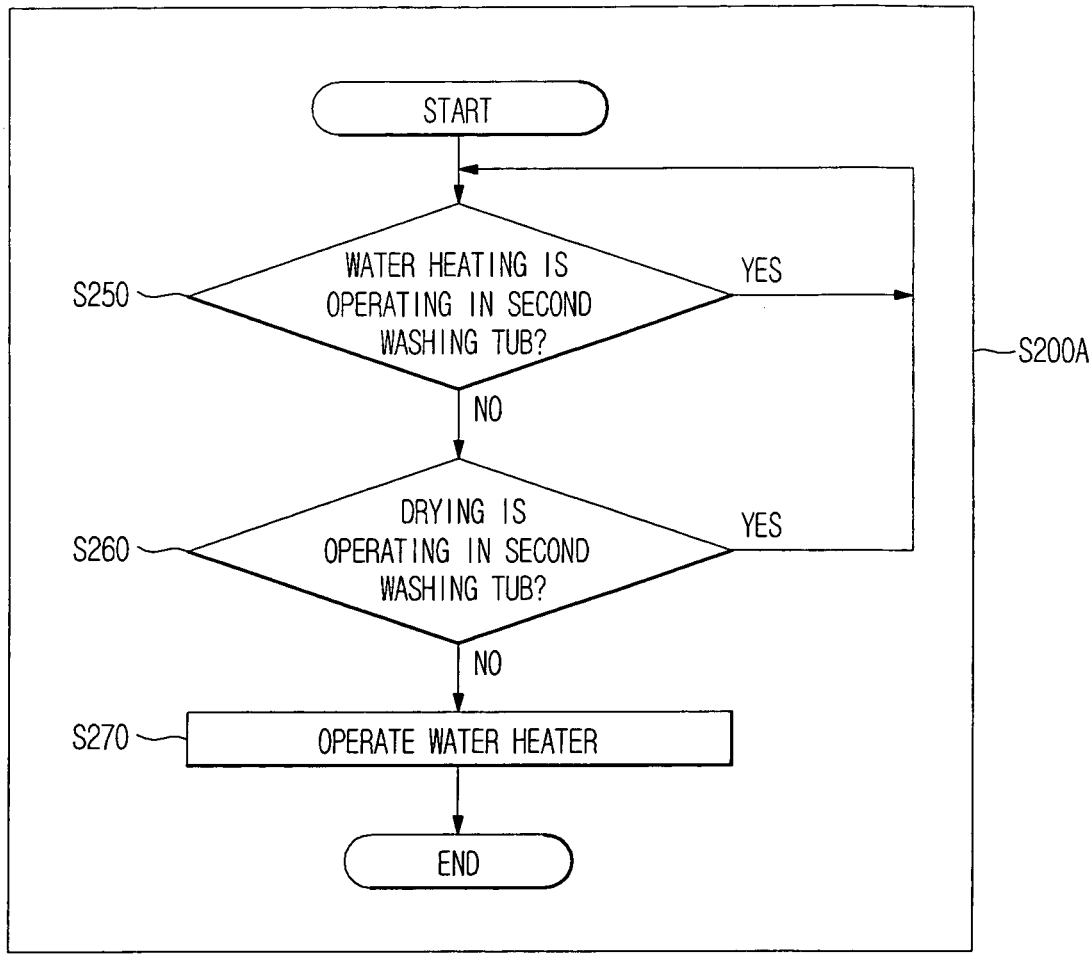
FIG. 7A is a flow chart showing another embodiment of a method of discriminating a condition capable of performing a water heating process and performing the water heating process.
Figure 7B:
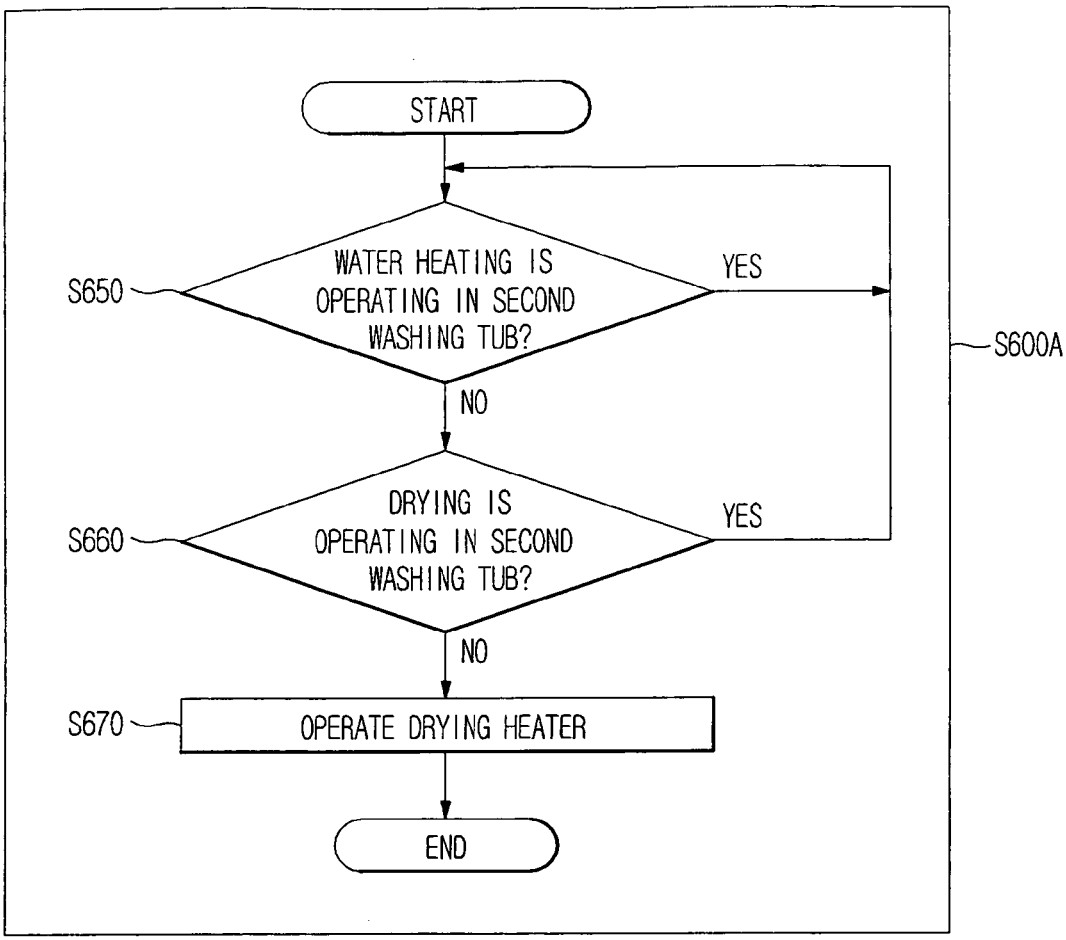
FIG. 7B is a flow chart showing another embodiment of a method of discriminating a condition capable of performing a drying process and performing the drying process.

FIG. 7A is a flow chart showing another embodiment of a method of discriminating a condition capable of performing the water heating process and performing the water heating process. And FIG. 7B is a flow chart showing another embodiment of a method of discriminating a condition capable of performing the drying process and performing the drying process. The methods of discriminating the conditions capable of performing the water heating process and the drying process are substantially similar.

When the water heating process in the first washing tub 301 is ready to be initiated or the drying process in the first washing tub 301 is ready to be initiated, the control unit 250 determines whether the water heater 702 in the second washing tub 302 is operating (operation S250 or operation S650). If the water heater 702 in the second washing tub 302 is operating, the control unit 250 delays the operation of the water heater 701 or the drying heater 641 in the first washing tub 301. If the water heater 702 in the second washing tub 302 is not operating, the control unit 250 determines whether the drying heater 642 in the second washing tub 302 is operating (operation S260 or operation S660). If the drying heater 642 in the second washing tub 302 is operating, the control unit 250 delays the operation of the water heater 701 or the drying heater 641 in the first washing tub 301. If the drying heater 642 in the second washing tub 302 is not operating, the control unit 250 initiates the operation of the water heater 701 (operation S270) or the drying heater 641 (operation S670) in the first washing tub 301.

The control methods in FIGS. 7A & B are different from the control methods in FIGS. 6A & B in that the control methods in FIGS. 7A & B are based on the discrimination of whether the water heater or the drying heater is actually operating, but the control methods in FIGS. 6A & B are based on the discrimination of whether the water heating process or the drying process is being performed. During the water heating process, the water heater does not continuously operate, but is turned on and off repeatedly within a predetermined temperature range. In the same manner, during the drying process, the drying heater is turned on and off repeatedly within a predetermined temperature range. Accordingly, in the control methods in FIGS. 7A & B, only when the water heater 702 or the drying heater 642 in the second washing tub 302 is actually operating, the control unit 250 delays the operation of the water heater 701 or the drying heater 641 in the first washing tub 301. When the water heater 702 or the drying heater 642 in the second washing tub 302 is turned off, the control unit 250 operates the water heater 701 or the drying heater 641 in the first washing tub 301.

Figure 8A:
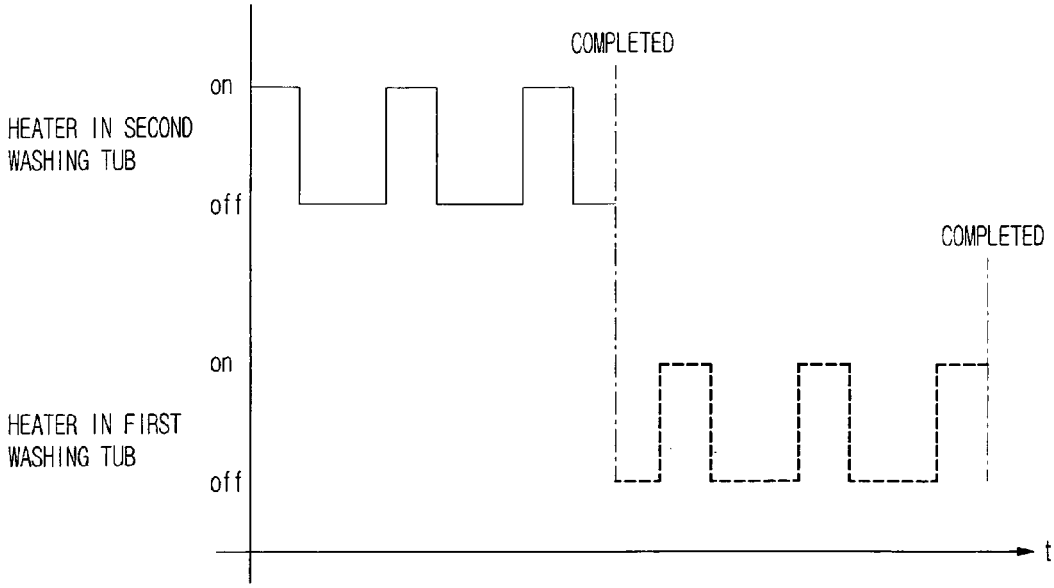
FIG. 8A is a graph showing a washing time according to the embodiments of FIG. 6A or FIG. 6B.
Figure 8B:
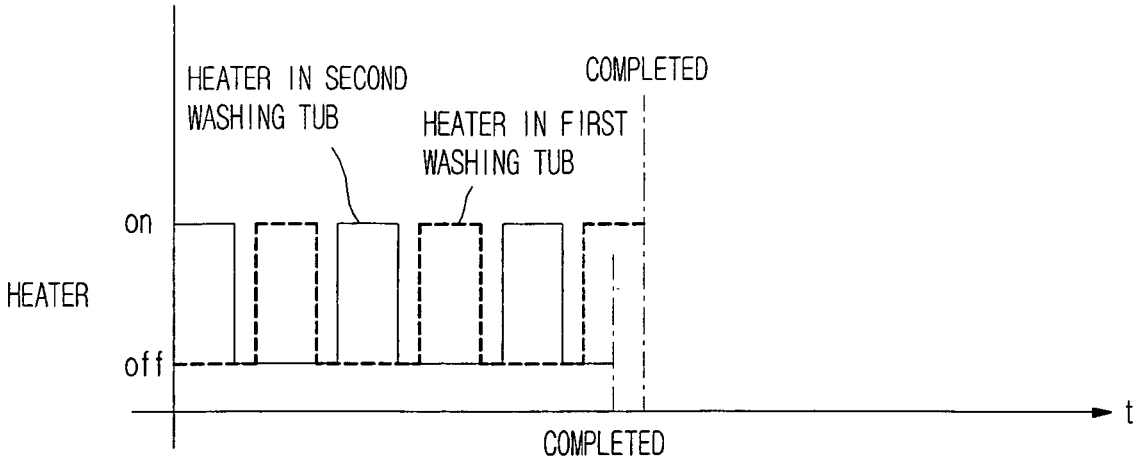
FIG. 8B is a graph showing a washing time according to the embodiments of FIG. 7A or FIG. 7B.

FIG. 8A and FIG. 8B are graphs showing the on/off states of the water heaters 701 and 702 or the drying heaters 641 and 642 in the first and second washing tubs 301 and 302 with the lapse of time according to the control methods in FIGS. 6A & B and FIGS. 7A & B, respectively.

As shown in FIG. 8A, according to the control methods in FIGS. 6A & B, when the water heating process or the drying process is being performed in the second washing tub 302, the water heating process or the drying process in the first washing tub 301 is delayed. Then, when the water heating process or the drying process in the second washing tub 302 is completed, the water heating process or the drying process in the first washing tub 301 is initiated.

As shown in FIG. 8B, according to the control methods in FIGS. 7A & B, when the water heater 702 or the drying heater 642 in the second washing tub 302 is in an on-state, the water heater 701 or the drying heater 641 in the first washing tub 301 is kept in an off-state. Then, when the water heater 702 or the drying heater 642 in the second washing tub 302 is turned off, the water heater 701 or the drying heater 641 in the first washing tub 301 is turned on. Accordingly, the time taken for the water heating process or the drying process in the first and second washing tubs 301 and 302 are reduced by half.

Figure 9:
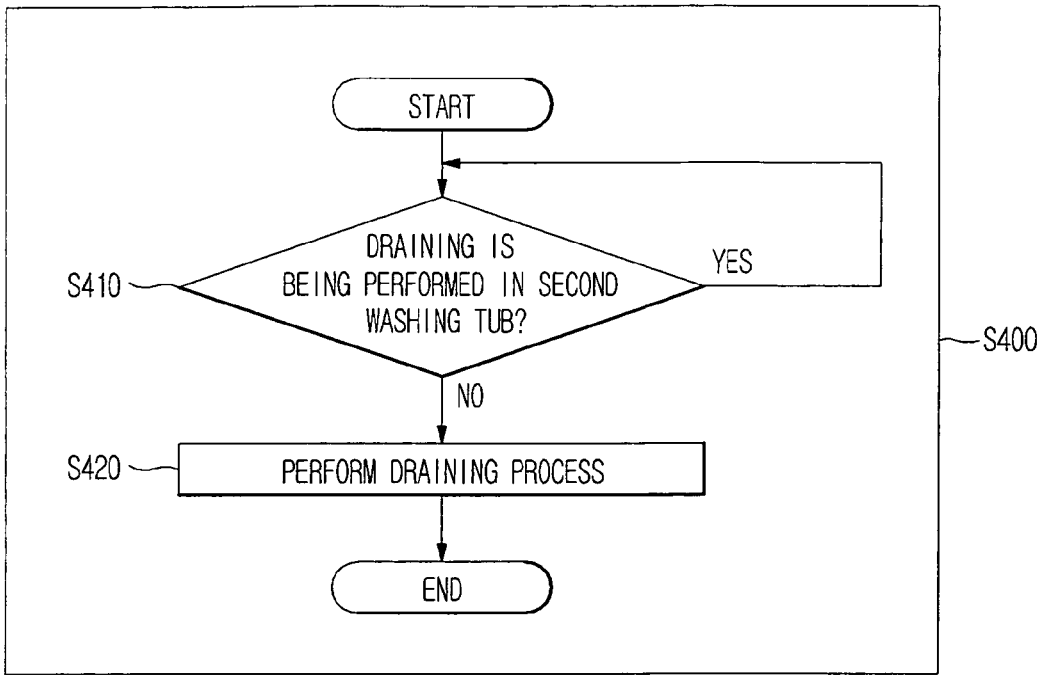
FIG. 9 is a flow chart showing a method of discriminating a condition capable of performing a draining process and performing the draining process.

FIG. 9 is a flow chart showing a method of discriminating a condition capable of performing the draining process and performing the draining process. If the washing process in the first washing tub 301 is completed, the water in the first washing tub 301 should be discharged. As shown in FIG. 9, if the draining process in the first washing tub 301 is ready to be initiated, the control unit 250 determines whether the draining process is being performed in the second washing tub 302 (operation S410). If the draining process is being performed in the second washing tub 302, the control unit 250 delays the draining process in the first washing tub 301 until the draining process in the second washing tub 302 is completed. If the draining process is not being performed in the second washing tub 302, the control unit 250 initiates the draining process in the first washing tub 301 (operation S420).

When water is being discharged from the second washing tub 302, if the water is discharged from the first washing tub 301 as well, the water cannot be discharged completely through the single external drain pipe 800 from both the washing tubs during the predetermined time. Accordingly, when the draining process in the second washing tub 302 is completed, the control unit 250 initiates the draining process in the first washing tub 301, to thereby discharge the water completely from both the first and second washing tubs 301 and 302 during the predetermined time.

Figure 10:
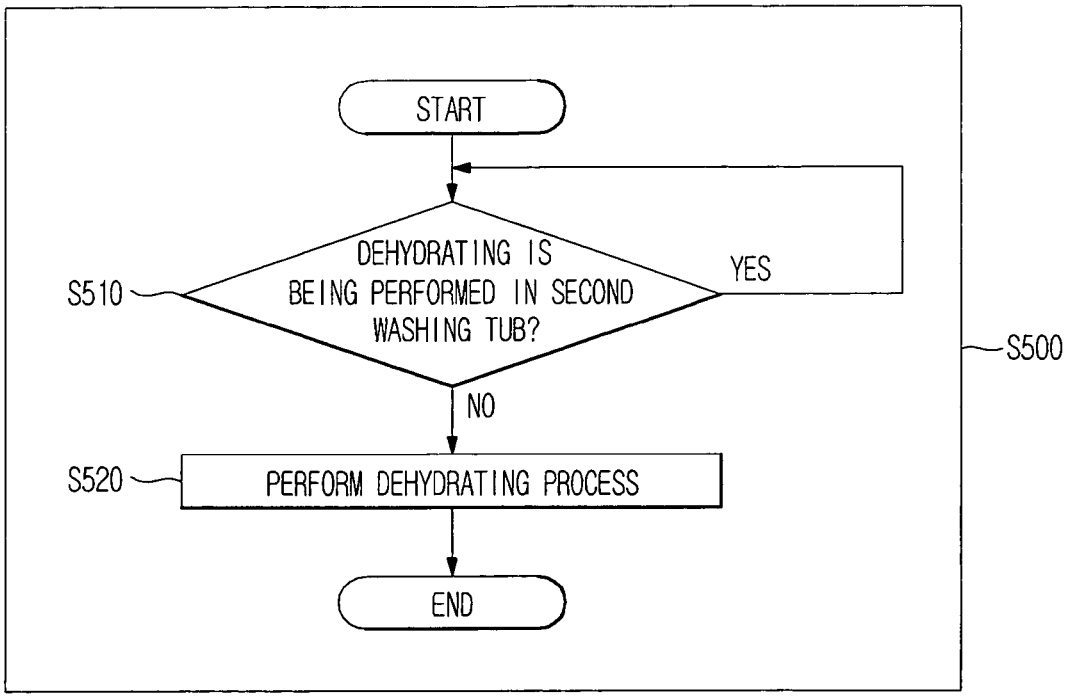
FIG. 10 is a flow chart showing a method of discriminating a condition capable of performing a dehydrating process and performing the dehydrating process.

FIG. 10 is a flow chart showing a method of discriminating a condition capable of performing the dehydrating process and performing the dehydrating process. As shown in the drawing, if the dehydrating process in the first washing tub 301 is ready to be initiated, the control unit 250 determines whether the dehydrating process is being performed in the second washing tub 302 (operation S510). If the dehydrating process is being performed in the second washing tub 302, the control unit 250 delays the dehydrating process in the first washing tub 301 until the dehydrating process in the second washing tub 302 is completed. If the dehydrating process is not being performed in the second washing tub 302, the control unit 250 initiates the dehydrating process in the first washing tub 301 (operation S520).

In general, the rotary drum rotates at high speed during the dehydrating process, which generates large noise and vibration. When the dehydrating process is being performed in the second washing tub 302, if the dehydrating process is performed in the first washing tub 301 as well, larger noise and vibration are generated due to the high-speed rotation of the rotary drums in both the first and second washing tubs 301 and 302, which may even cause damage to the washing machine. To prevent this problem, while the dehydrating process is being performed in the second washing tub 302, the dehydrating process in the first washing tub 301 is controlled to be delayed, as described above.

Although the drum type washing machine having two tubs have been used for example for explaining the control methods described herein, other types (e.g., non-drum type) washing machine having two or three tubs can be controlled by the control methods described herein.

As is apparent from the above description, the control method of the multi-tub washing machine according to an embodiment of the present invention delays the water supplying or the draining in one washing tub until the water supplying or the draining in the other washing tub is completed, upon receiving the water supplying command or the draining command to be performed in both the washing tubs simultaneously, to thereby achieve the water supplying or the draining in the respective washing tubs.

Also, the control method according to an embodiment of the present invention prohibits the water heaters and/or the drying heaters in the washing tubs from being operated simultaneously, upon receiving the water heating command or the drying command to be performed in both the washing tubs simultaneously, or upon receiving the water heating command to be performed in one washing tub and the drying command to be performed in the other washing tub, to thereby prevent breakage of electrical components due to an overload.

Also, the control method according to an embodiment of the present invention prohibits the simultaneous performance of the dehydration process, upon receiving the dehydrating command to be performed in both the washing tubs simultaneously, to thereby prevent noise or breakage of the washing machine due to resonance.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of controlling a washing machine including a first washing tub and a second washing tub, the method comprising:

receiving a first operating command to be performed in the first washing tub, the first operating command being any one of a water heating process and a drying process using a first heater;

determining whether the first operating command can be performed in the first washing tub, the first operating command being determined to be able to be performed when a second operating command being any one of a water heating process and a drying process and using a second heater is not being performed in the second washing tub, the first operating command being determined to not be able to be performed when the second operating command using the second heater is being performed in the second washing tub so that the first and second heaters are not operated simultaneously; and performing the first operating command in the first washing tub when it is determined that the first operating command is able to be performed.

2. The method according to claim 1, further comprising:

upon receiving the second operating command to be performed in the second washing tub simultaneously, determining whether the first and second operating commands to be performed in the first and second washing tubs can be simultaneously performed;

when the first and second operating commands are incapable of being performed, determining which of the first washing tub and the second washing tub has a priority; and performing the operating command preferentially in the washing tub having the priority.

3. The method according to claim 1, further comprising:

upon receiving the second operating command to be performed in the second washing tub simultaneously, determining whether the first and second operating commands to be performed in the first and second washing tubs can be simultaneously performed;

when the first and second operating commands are incapable of being performed, determining which of the first washing tub and the second washing tub has a shorter remaining washing time; and performing the operating command preferentially in the washing tub having the shorter remaining washing time.

4. The method according to claim 1, further comprising:

if the first operating command calls for the water heating process, determining whether the drying process is being performed in the second washing tub based on the second operating command; and when the drying process is being performed in the second washing tub, determining that the water heating process is incapable of being performed.

5. The method according to claim 1, further comprising:

if the first operating command calls for the drying process, determining whether a water supplying process or the water heating process is being performed in the second washing tub based on the second operating command; and when the water supplying process or the water heating process is being performed in the second washing tub, determining that the drying process is incapable of being performed.

6. The method according to claim 5, wherein, when the first operating command calls for the drying process and the second operating command calling for the water supplying process or the water heating process are simultaneously input, the drying process is primarily performed.

7. The method according to claim 1, wherein the first and second washing tubs each include a water heater and a dryer heater, the first heater being one of a first water heater and a first dryer heater, the second heater being one of a second water heater and a second dryer heater, and, when the first operating command calls for operation of the first water heater, the method further comprises:

determining whether the second drying heater is being operated in the second washing tub based on the second operating command; and when the second drying heater is being operated in the second washing tub, determining that the operation of the first water heater is incapable of being performed.

8. The method according to claim 1, wherein the first and second washing tubs each include a water heater and a drying heater, the first heater being one of a first water heater and a first dryer heater, the second heater being one of a second water heater and a second dryer heater, and when the first operating command calls for operation of the first drying heater, the method further comprises:

determining whether the second water heater is being operated in the second washing tub based on the second operating command; and when the second water heater is being operated in the second washing tub, determining that the operation of the first water heater is incapable of being performed.

9. The method according to claim 8, wherein, when the first operating command calling for the operation of the first drying heater and the second operating command calling for the operation of the second water heater are simultaneously input, the operation of the first drying heater is primarily performed.

10. The method according to claim 1, further comprising:

when the first operating command is incapable of being performed in the first washing tub, delaying performing the first operating command in the first washing tub until the second operating command is completed in the second washing tub.

* * * * *